US005295055A

United States Patent [19]

Brock et al.

[11] Patent Number: 5,295,055

[45] Date of Patent: Mar. 15, 1994

[54] PORTABLE ELECTRIC CORD LIGHTING

[76] Inventors: Allen L. Brock, 3227 Whittle Way, Midland, Tex. 79707; George Spector, 233 Broadway RM 702, New York, N.Y. 10279

[21] Appl. No.: 991,423

[22] Filed: Dec. 16, 1992

[51] Int. Cl.[5] ..... F21V 21/14

[52] U.S. Cl. ..... 362/249; 362/128; 362/140; 362/391; 362/397; 439/110

[58] Field of Search ..... 439/110, 207, 208; 362/128, 129, 135, 140, 141, 249, 250, 252, 387, 397, 391

[56] References Cited

U.S. PATENT DOCUMENTS

| | | | |
|---|---|---|---|
| 1,897,802 | 2/1933 | Henkel | 362/129 |
| 2,052,425 | 8/1936 | Simeone | 362/397 |
| 3,025,389 | 3/1962 | Esch | 362/128 |
| 3,268,715 | 8/1966 | Rothman | 362/129 |
| 4,821,162 | 4/1989 | Ellis | 439/110 |
| 4,907,137 | 3/1990 | Schladitz et al. | 439/110 |
| 5,016,145 | 5/1991 | Singleton | 362/397 |

*Primary Examiner*—Richard R. Cole
*Assistant Examiner*—Alan B. Cariaso

[57] ABSTRACT

A portable auxiliary illumination device is provided, which consists of an elongated power cord and a plug at one end of the power cord for engagement with an outlet to receive electrical current therefrom. A plurality of sockets are located in series along the length of the power cord. A plurality of suction cups are each connected to one of the sockets, sot hat the sockets can be removably attached to a flat surface of a mirror. A plurality of light bulbs are each removably disposed within each socket to produce additional light for dimly lit areas adjacent the mirror.

1 Claim, 1 Drawing Sheet

PORTABLE ELECTRIC CORD LIGHTING

BACKGROUND OF THE INVENTION

The instant invention relates generally to lamps and more specifically it relates to a portable auxiliary illumination device, which provides additional light for dimly lit areas by attachment with suction cups to a mirror surface.

There are available various conventional lamps which do not provide the novel improvements of the invention herein disclosed.

SUMMARY OF THE INVENTION

A primary object of the present invention is to provide a portable auxiliary illumination device that will overcome the shortcomings of the prior art devices.

Another object is to provide a portable auxiliary illumination device that can be removably installed to a surface of a mirror by suction cups to produce additional light for dimly lit areas.

An additional object is to provide a portable auxiliary illumination device that contains light sockets on a power cord, which can be slide therealong on a flexible track to differentiate positions to place light at specific dimly lit areas near the surface of the mirror.

A further object is to provide a portable auxiliary illumination device that is simple and easy to use.

A still further object is to provide a portable auxiliary illumination device that is economical in cost to manufacture Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
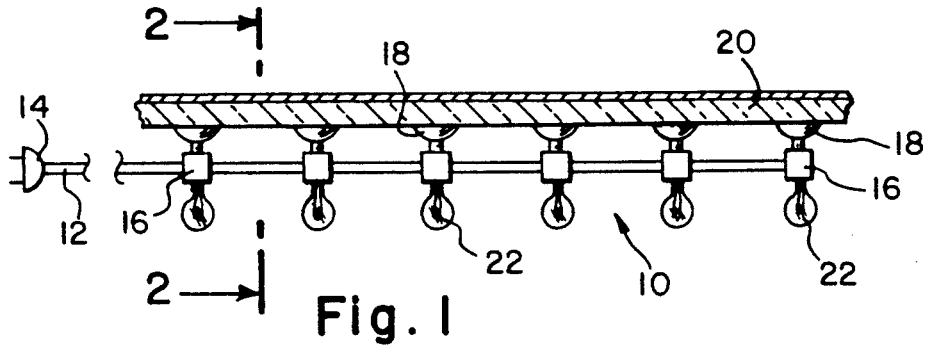
FIG. 1 is a top elevational view of the instant invention installed on a mirror shown in section.

Turning now descriptively to the drawings, in which similar reference characters denote similar elements throughout the several views, the Figures illustrate a portable auxiliary illumination device 10, which consists of an elongated power cord 12 and a plug 14 at one end of the power cord 14 for engagement with an outlet (not shown) to receive electrical current therefrom. A plurality of sockets 16 are located in series along the length of the power cord 14. A plurality of suction cups 18, are each connected to one of the sockets 16, so that the sockets 16 can be removably attached to a flat surface of a mirror 20. A plurality of light bulbs 22, are each removably disposed within each socket 16 to produce additional light for dimly lit areas adjacent the mirror 20.

Figure 2:
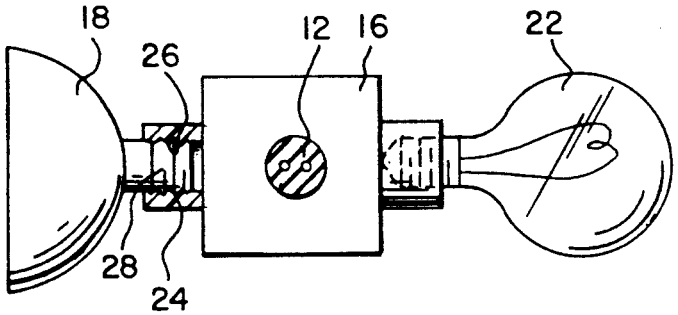
FIG. 2 is an enlarged cross sectional view taken along line 2–2 in FIG. 1, showing a first modification in which the suction cup and the light bulb are removable.

As best seen in FIG. 2, a plurality of connectors 24 are provided, with each having a threaded aperture 26 and is affixed to one of the sockets 16. Each suction cup 18 has a threaded shank 28 to removably engage with the threaded aperture 26 in one of the connectors 24, so that the suction cups 18 can be removed and replaced when needed.

Figure 3:
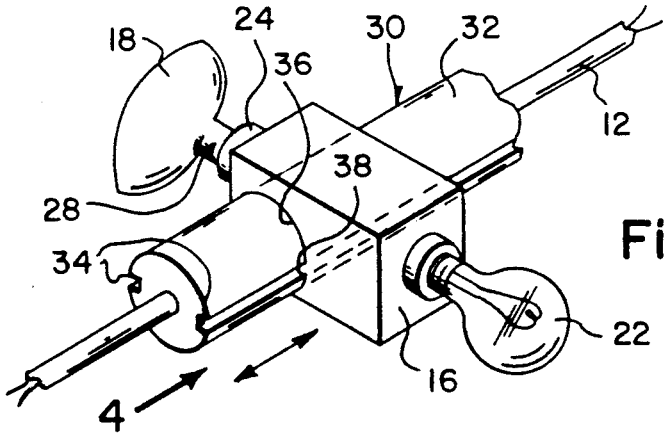
FIG. 3 is an enlarged perspective view of a portion of a second modification in which the socket slides upon a flexible track on the power cord.

FIG. 3 shows a mechanism 30 on the power cord 12, for allowing each socket 16 to slide to a different position, so as to place the additional light at specific dimly lit areas adjacent the mirror 20.

Figure 4:
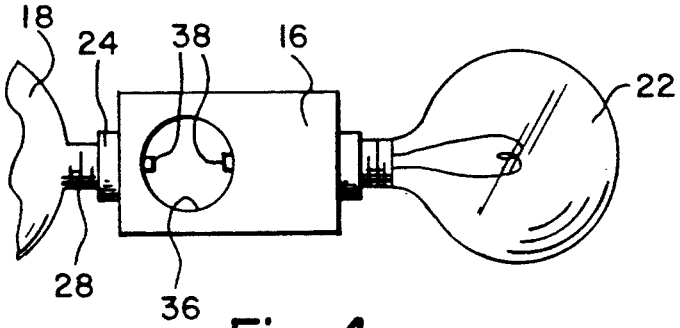
FIG. 4 is an elevational view taken in the direction of arrow 4 in FIG. 3, with the flexible track and power cord removed therefrom to better show the electrical contact pin within the socket aperture.

The sliding mechanism 30 includes a flexible track 32 mounted on the power cord 12. A pair of recessed electrical contact strips 34 are spaced apart in a parallel longitudinal relationship on the flexible track 32. Each socket 16 has a transverse aperture 36 therethrough, with a pair of spaced apart electrical contact pins 38 within the transverse aperture 36 (see FIG. 4). Each socket 16 can ride on the flexible track 32 through the transverse aperture 36, with the contact pins 38 riding on the recessed electrical contact strips 34.

While certain novel features of this invention have been shown and described and ar pointed out in the annexed claims, it will be understood that various omissions, substitutions and changes in the forms and details of the device illustrated and in its operation can be made by those skilled in the art without departing from the spirit of the invention.

What is claimed is:

1. A portable auxiliary illumination device which comprises:

a) an elongated power cord;

b) a plug at one end of said power cord for engagement with an outlet to receive electrical current therefrom;

c) a plurality of sockets located in series along the length of said power cord d) a plurality of suction cups, each connected to one of said sockets, so that said sockets can be removably attached to a flat surface of a mirror;

e) a plurality of light bulbs, each removably disposed within each said socket to produce additional light for dimly lit areas adjacent the mirror; and f) a plurality of connectors, each having a threaded aperture and affixed to one of said sockets;

g) each said suction cup having a threaded shank to removably engage with the threaded aperture in one of said connectors, so that said suction cups can be removed and replaced when needed; further including means on said power cord for allowing each said socket to slide to a different position, so as to place the additional light at specific dimly lit areas adjacent the mirror; wherein said socket sliding means includes;

h) a flexible track mounted on said power cord;

i) a pair of recessed electrical contact strips spaced apart in a parallel longitudinal relationship on said flexible track; and j) each said socket having a transverse aperture therethrough, with a pair of spaced apart electrical contact pins within said transverse aperture, so that each said socket can ride on said flexible track through said transverse aperture with said contact pins riding on said recessed electrical contact strips.

* * * * *